US006644227B2

(12) United States Patent
Sano et al.

(10) Patent No.: US 6,644,227 B2
(45) Date of Patent: Nov. 11, 2003

(54) EMBROIDERY STITCHING DEVICE AND SEWING MACHINE HAVING A FREE ARM

(75) Inventors: Yasuro Sano, Tokyo (JP); Koshiro Omiya, Tokyo (JP); Eiji Murakami, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 0 days.

(21) Appl. No.: 10/023,574

(22) Filed: Dec. 18, 2001

(65) Prior Publication Data

US 2002/0083873 A1 Jul. 4, 2002

(30) Foreign Application Priority Data

Dec. 28, 2000 (JP) ..... 2000-399656

(51) Int. Cl.[7] ..... D05C 5/02; D05B 21/00

(52) U.S. Cl. ..... 112/102.5; 112/470.03; 112/475.02

(58) Field of Search ..... 112/102.5, 103, 112/470.06, 470.01, 470.03, 63, 260, 306, 470.07, 475.02

(56) References Cited

U.S. PATENT DOCUMENTS 4,003,322 A * 1/1977 Yanikoski ..... 112/102.5
4,664,048 A * 5/1987 Naganuma et al. ..... 112/306 X
4,827,856 A * 5/1989 Rohr ..... 112/63
5,850,792 A * 12/1998 Adamski, Jr. et al. .. 112/470.07

* cited by examiner

*Primary Examiner*—Peter Nerbun
(74) *Attorney, Agent, or Firm*—Nields & Lemack

(57) ABSTRACT

A sewing machine having a free arm which is provided with free arm sensors 5 and 6 for detecting a contact between the free arm and a cylindrical work during embroidery stitching operation, the cylindrical work being held by an embroidering frame 23 and placed on the free arm as covering the same so as to be embroidered thereon. The contact as detected is indicated to the machine user or the sewing machine is stopped. Further, the contact detection may be used to seek an area where the work may be allowed to be embroidered. The area as sought is discriminated prior to initiation of stitching operation if the work may be embroidered in the area.

16 Claims, 5 Drawing Sheets

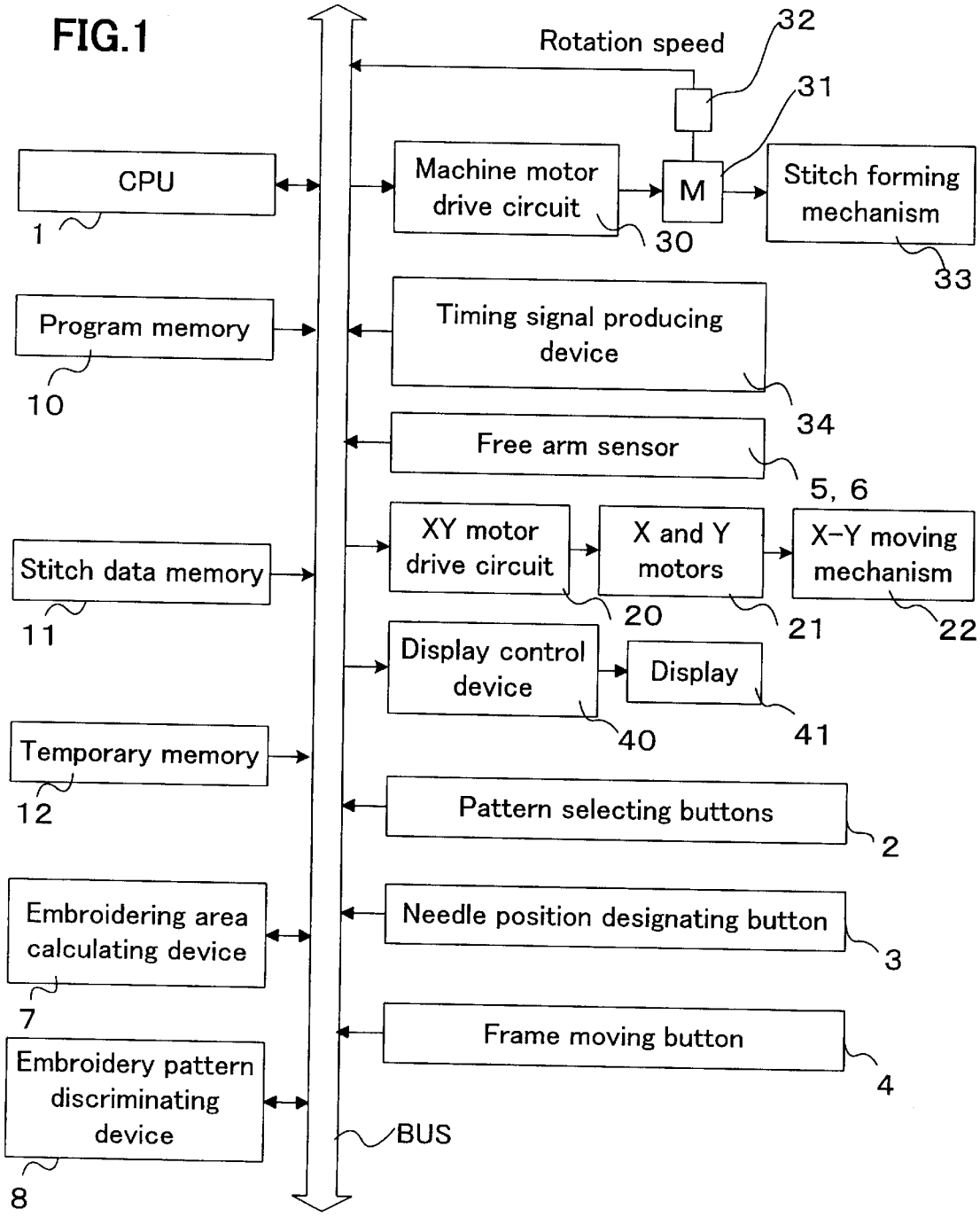
FIG.1
Rotation speed
32
31
CPU
1
Machine motor drive circuit
30
M
Stitch forming mechanism
33
Program memory
10
Timing signal producing device
34
Free arm sensor
5, 6
Stitch data memory
11
XY motor drive circuit
20
X and Y motors
21
X-Y moving mechanism
22
Display control device
40
Display
41
Temporary memory
12
Pattern selecting buttons
2
Embroidering area calculating device
7
Needle position designating button
3
Frame moving button
4
Embroidery pattern discriminating device
8
BUS

EMBROIDERY STITCHING DEVICE AND SEWING MACHINE HAVING A FREE ARM

BACKGROUND OF THE INVENTION AND RELATED ART STATEMENT

1. Field of the Invention

The present invention relates to embroidery stitching device and sewing machine having a free arm and more particularly relates to the embroidery stitching device and sewing machine having a free arm which is provided to embroider a cylindrical work thereon and has sensor means for detecting a condition that a part of the work contacts the free arm during stitching operation to prevent the work from being further stitched and then for determining and/or indicating an area where the work may be embroidered.

2. Prior Art

It is generally known that a sewing machine or device for embroidery stitching is provided with a free arm which is used in case embroidery patterns are stitched at a work of cylindrical shape such as a sleeve of clothes. In case an embroidery stitching operation is carried out at the cylindrical work which is held by an embroidering frame and placed on the free arm as surrounding the same, it is required to move the embroidering frame in an area where the embroidering frame is allowed to move without the work being caught by the free arm. If the stitching operation is continued beyond the area, the mechanism and/or the work may be damaged.

As to the embroidery stitching device and sewing machine having a free arm, the area where the embroidering frame may be moved is generally predetermined at the time of production of the device and/or sewing machine having a specific design while the area where the free arm may allow the work to move is different in dependence upon the individual works to be embroidered.

The machine user is, therefore, required to calculate the size of the work to be embroidered so as to decide if the work may be embroidered in the predetermined area. It is actually a very troublesome task for the machine user to make the decision. The decision, if not correct, will cause a damage of the work and/or the mechanism.

OBJECTS OF THE INVENTION

The invention has been provided to eliminate the defects and disadvantages of the prior art.

It is, therefore, a primary object of the invention to provide embroidery stitching device and sewing machine having a free arm having sensor means provided therewith to detect if the work is in contact with the free arm during stitching operation and to decide and/or indicate an area where the work may be stitched.

It is another object of the invention to provide the stitching area deciding and/or indicating device which is simple in structure and reliable in operation.

The other objects and advantages of the invention will be apparent in the following detailed description of the invention in reference to preferred embodiments.

SUMMARY OF THE INVENTION

For attaining the objects, the embroidery stitching device having a free arm of the invention comprises means for holding a work to be embroidered and for moving the work, means provided on the free arm to detect a contact or access between said work and said free arm.

The detecting means may detect a contact or access between said work and said free arm to stop the embroidery stitching device or to indicate the machine user to take a required action.

The embroidery stitching device may include means which is responsive to a detecting signal from the detecting means to detect an area where the work may be moved and indicate the machine user to decide if the stitching operation may be continued or not.

The embroidery stitching device may further include means for giving information regarding a pattern to be embroidered to the work and means responsive to the information from the information giving means and the information from the detecting means to discriminate if the pattern may be embroidered in the detected area.

In this case, it is preferable that embroidery stitching device further includes means for designating a position where the pattern is embroidered, the position designating means being operated to change an embroidering position in case the discriminating means discriminates that the pattern will not be embroidered in the detected area.

It is further preferable that the embroidery stitching device includes means for designating a size of a pattern to be embroidered and means for changing the designated size of the pattern in case the size of the pattern designated by the designating means is discriminated by the discriminating means to be something to be improper for embroidering.

The embroidery stitching device as above mentioned will be made up in a swing machine for embroidery stitching operation.

BRIEF DESCRIPTION OF THE DRAWING

FIG. 1 is a block diagram showing the functions of an embodiment of the invention by way of example.

DETAILED DESCRIPTION OF PREFERRED EMBODIMENTS

The invention will be described in reference to the embodiments as shown in the attached drawings.

Figure 2:
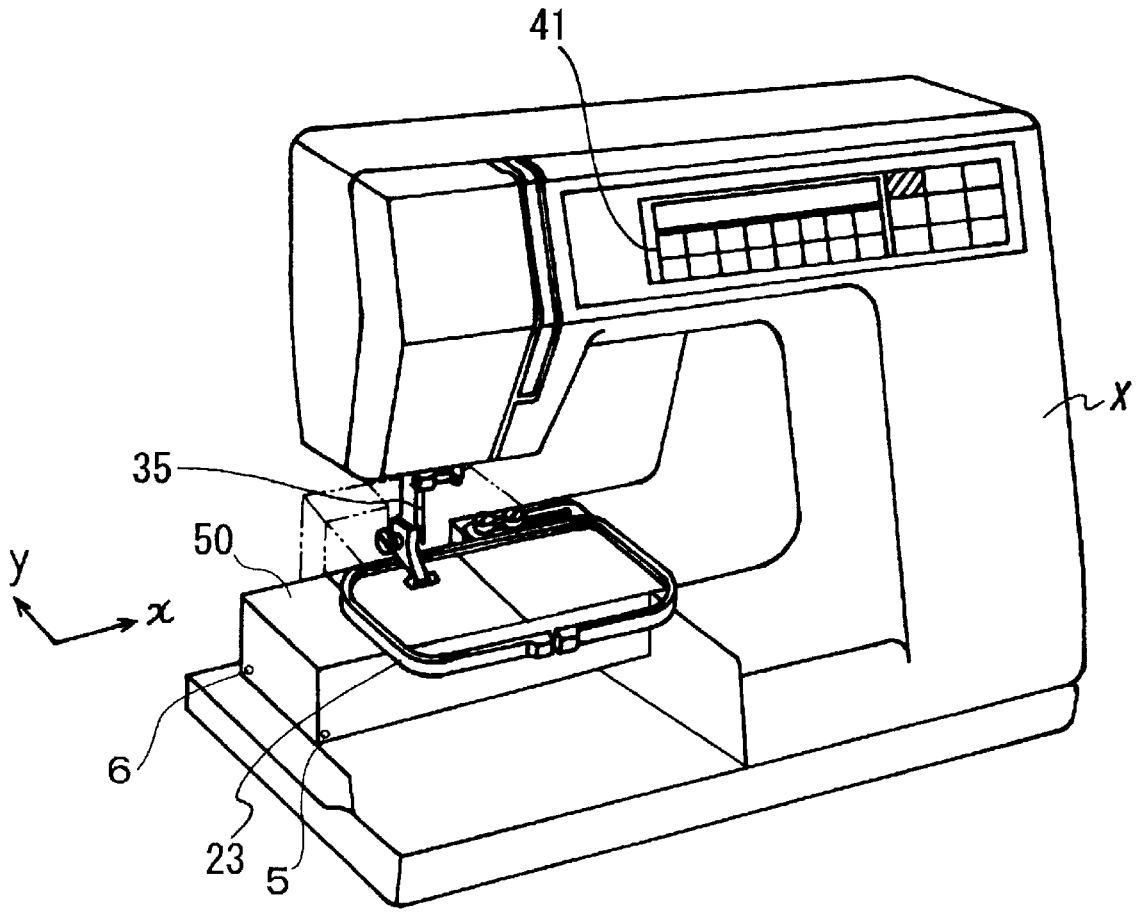
FIG. 2 is a perspective view of one embodiment of the invention having a free arm.

FIGS. 1 and 2 show a sewing machine having an embroidery stitching device provided therewith wherein CPU 1 is used to control the general operations of the sewing machine by means of the programs stored in a program memory 10. The CPU 1 controls the operation of a machine motor 31 through a machine motor drive circuit 30 to drive a stitch forming mechanism 33, thereby to form stitches. As shown in FIG. 2, the stitch forming mechanism 33 includes a needle 35. The rotation speed of the machine motor 31 is detected by a rotation speed sensor 32 and is feedbacked to the CPU 1. A timing signal generating device 34 is provided to produce a timing signal.

Further, a display 41 is provided to indicate various information thereat under control of a display control device 40.

As shown in FIG. 2, an embroidering frame 23 is arranged to move in X-Y directions on a free arm 50 of the sewing machine. The embroidering frame 23 may be moved by an X-Y moving mechanism 22 which are operated by X and Y motors 21 which are driven under control of an X-Y motor drive circuit 20.

A stitch data memory 11 is provided to have various stitch data stored therein for embroidering various embroidery patterns which may be optionally selected with a variable size by operation of pattern selecting buttons 2. Further, a needle position designating button 3 is provided to designate a position where an embroidery pattern is stitched.

Further, a temporary memory 12 is provided to temporally store required data therein.

Figure 3:
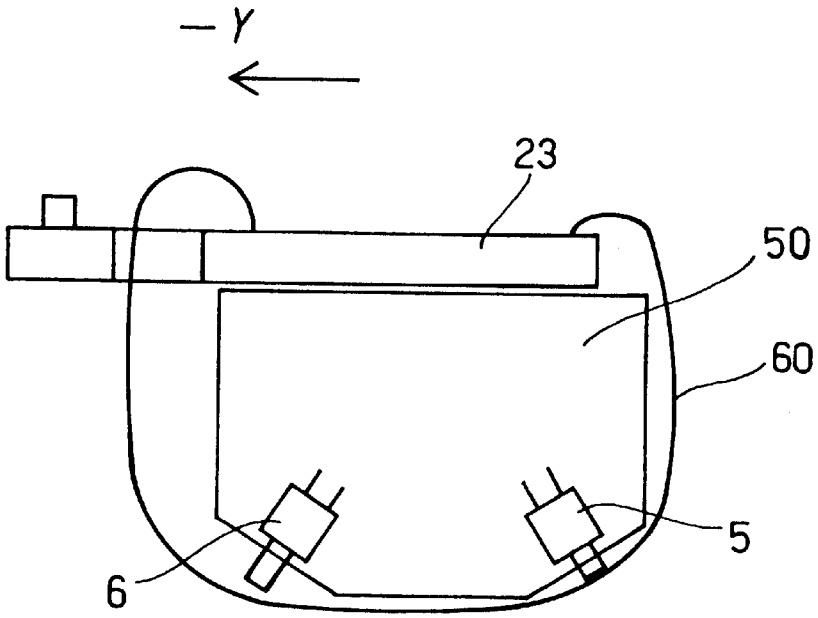
FIG. 3 is an essential part of the embodiment of the invention shown in vertical section in one condition between the free arm and a work to be stitched on the free arm.
Figure 4:
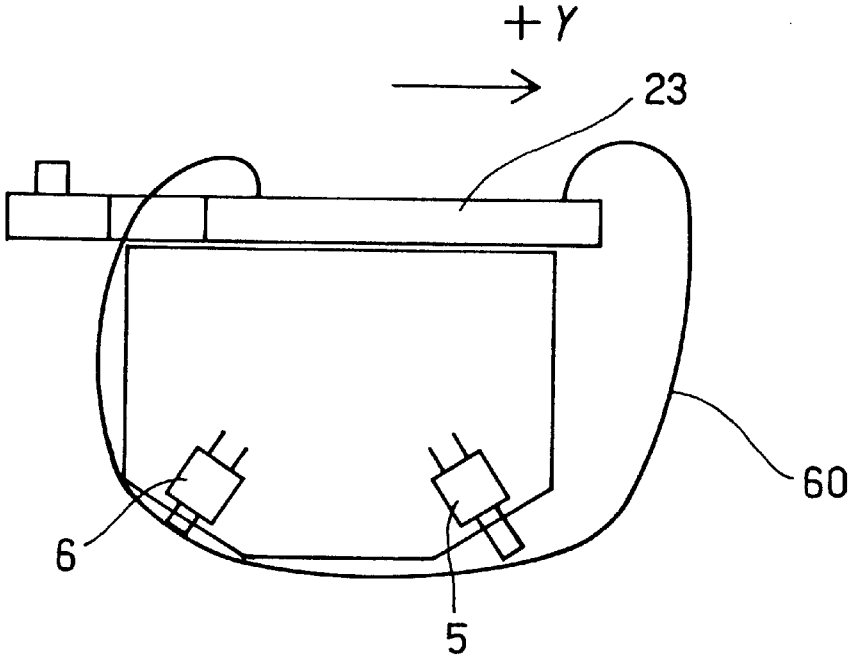
FIG. 4 is the essential part of the embodiment of the invention shown in vertical section in another condition between the free arm and a work to be stitched on the free arm.

The free arm 50 has a free arm sensor 5 and another free arm sensor 6 provided thereat. The free arm sensor 5 is, as shown in FIG. 2, is located at a front side of the free arm in the Y-direction and the free arm sensor 6 is located at a rear side of the free arm in the Y-direction so as to detect a work 60 to be stitched as shown in FIGS. 3 and 4.

According to the embodiment, the free arm sensors 5 and 6 are switches which may be pushed by the work 60 to be operative to detect the contact between the work 60 and the free arm 50 while the work 60 is moved as the embroidering frame 23 is moved.

A frame moving button 4 is provided so as to be operated to reciprocatingly move the embroidering frame 23 in the Y-direction, so that the machine user may confirm that a part of the work 60 will come to contact the free arm sensors 5, 6 and may change the moving direction of the embroidering frame 23 when a signal is produced from the free arm sensors 5, 6.

A calculating device 7 is provided for calculating an area where an embroidery pattern may be stitched. The calculating device 7 is responsive to a signal from the free arm sensors 5, 6 to calculate out the embroidery pattern stitching area in the Y-direction.

A discriminating device 8 is provided for discriminating if a selected pattern may be embroidered or not. Precisely the discriminating device 8 is responsive to pattern selecting information produced by pattern selecting operation of the pattern selecting buttons 2 to discriminate if the selected pattern may be embroidered or not, the information including a size of the selected pattern, an embroidery stitching position designated by operation of the needle position designating button 3 and an embroidery pattern stitching area calculated out by the device 7.

With the constituent elements being provided in combination as mentioned above, the CPU 1 is responsive to the signal from the free arm sensors 5, 6 during embroidery stitching operation to indicate the effect at the display 41 so that the machine user may be informed of the effect to change the moving direction of the embroidering frame 23 in the Y-direction. Otherwise, the CPU 1 may be operated to control the X Y motor drive circuit 20 so as to stop the embroidering frame 23.

Further, according to the embodiment, the frame moving button 4 is operated prior to initiation of embroidery stitching operation to discriminate if a designated pattern may be embroidered or not.

Figure 5:
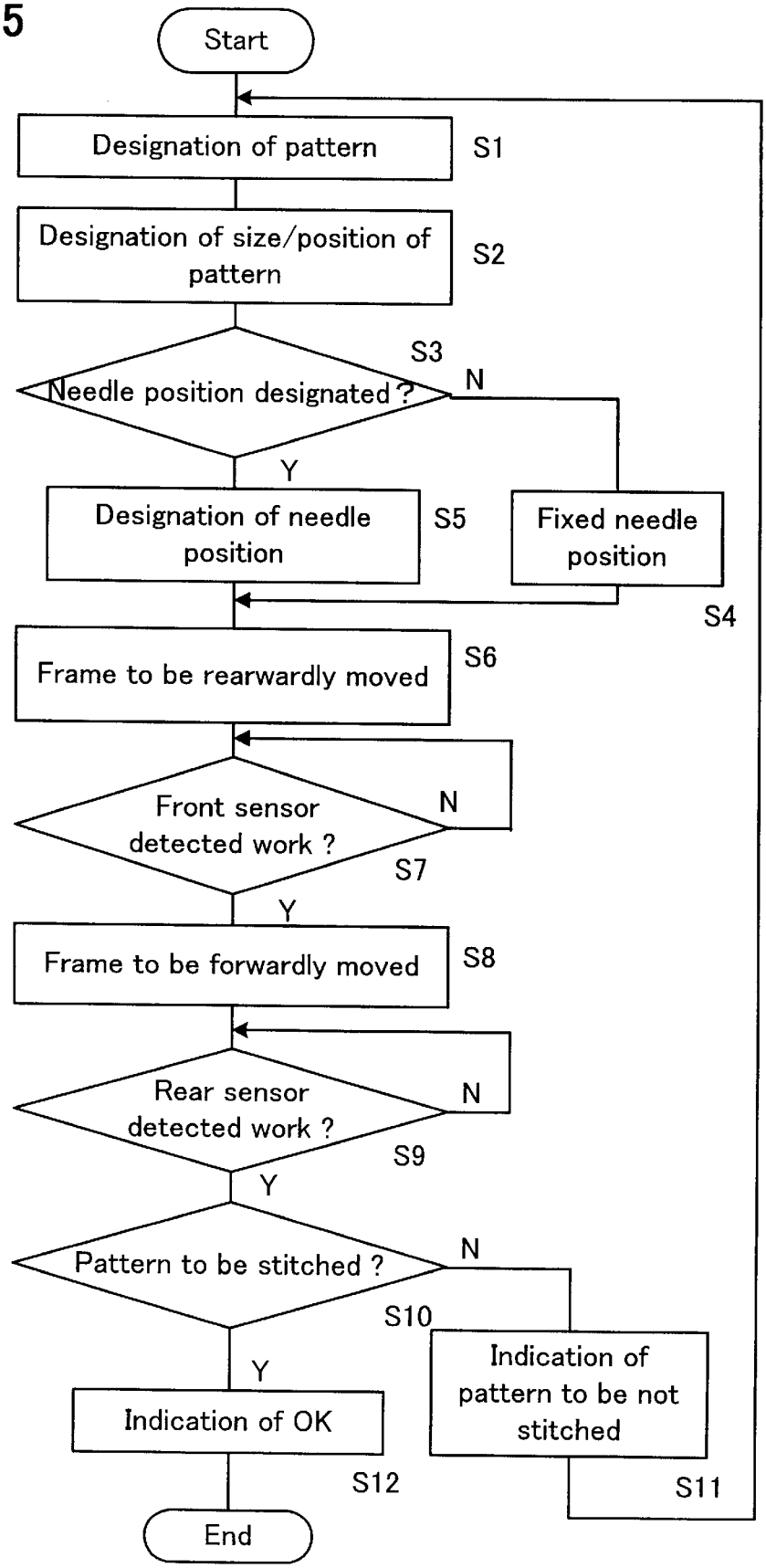
FIG. 5 is a flow chart showing one mode of operations of the embodiment of the invention.
Figure 6:
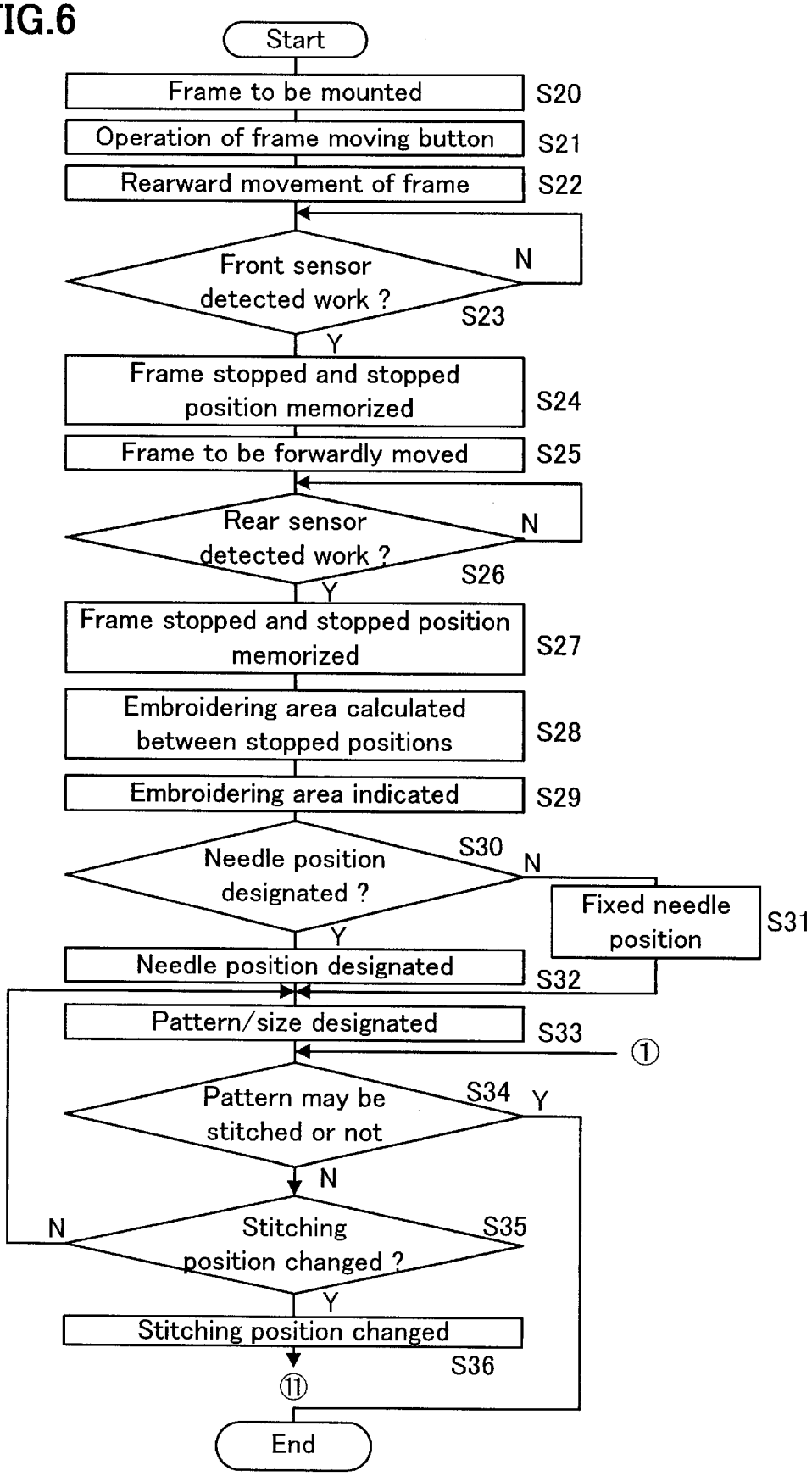
FIG. 6 is a flow chart showing another mode of operations of the embodiment of the invention.

This operation is shown in FIGS. 5 and 6.

FIG. 5 shows the operation for designating a pattern to be embroidered.

With operation of the pattern selecting buttons 2, a pattern is designated (step S1) to be embroidered and then a size of the pattern is designated (step S2). Subsequently the needle position designating button 3 is operated to designate a needle position or a fixed needle position is designated (steps S3, S4, S5).

Subsequently the frame moving button 4 is operated to move the embroidering frame 23 in the Y-direction far from the machine user (step S6) until the work 60 is detected by the free arm sensor 5 which is arranged at the front side of the free arm 50 (step S7) as shown in FIG. 3. Then the embroidering frame 23 is moved back toward the machine user (step S8) until the work 60 is detected by the free arm sensor 6 which is arranged at the rear side of the free arm 50 (step S9) as shown in FIG. 4.

The calculating device 7 is then operative to calculate out the area where the designated pattern is embroidered. Then the discriminating device is operative to discriminate if the designated pattern may be embroidered or not in the calculated area (step S10). The discriminated result is indicated at the display 41 (steps S11, S12).

With the process of operations as mentioned above, the machine user may know if the designated pattern of the size may be embroidered in the designated position.

FIG. 6 shows the operation for acknowledging an area where a designated pattern may be embroidered.

The embroidering frame 23 is mounted to the machine (step S20). The frame moving button 4 is operated (step S21) to move the embroidering frame 23 in the direction far from the machine user in the Y-direction (step S22) until the free arm sensor 5 arranged at the front side of the free arm 50 detects the work 60 (step S23) as shown in FIG. 3. With the work 60 being detected by the free arm sensor 5, the embroidering frame 23 is stopped and the stopped position is stored in the temporary memory 12 (step S24). Subsequently the embroidering frame 23 is moved back toward the machine user in the Y-direction (step S25) until the free arm sensor 6 arranged at the rear side of the free arm 50 detects the work 60 (step S26) as shown in FIG. 4. With the work 60 being detected by the free arm sensor 6, the embroidering frame 23 is stopped and the stopped position is stored in the temporary memory 12 (step S27). Then the calculating device 7 is operative to calculate out the area where the designated pattern is embroidered (step S28) on the basis of the information including the stopped positions of the embroidering frame 23 stored in the temporary memory 12 and indicates the area at the display 41 (step S29).

In case the machine user selects a fixed needle position with or without designation of a needle position by operation of the needle position designating button 3 (steps S30, 31, 32) and designates a pattern and a size of the pattern with operation of the pattern selecting buttons 2 (step S33), the discriminating device 8 will discriminate if the designated pattern may be embroidered or not (step S34). In case the discrimination is negative, the machine user is required to change the needle position (steps S35, 36) by operation of the needle position designating button 3 or to change the designated pattern and/or the size thereof (step S33).

As is described above, according to the embroidery stitching device and sewing machine having a free arm for embroidery stitching operation of the invention, the cylindrical work such as the sleeves of clothes and the cuffs of trousers may be embroidered in an area which is detected by the free arm sensors 5 and 6 which are provided to detect the contact between the free arm and the work to indicate the contact to the machine user or to stop the movement of the embroidering frame 23.

Further, with provision of the stitching area calculating device 7 and the discriminating device 8, it is possible to decide if a designated pattern may be embroidered or not.

The invention being thus described, it will be obvious that the same may be varied in many ways. Such variations are not to be regarded as a departure from the spirit and scope of the invention, and all such modifications are intended to be included within the scope of the following claims.

What is claimed is:

1. An embroidery stitching device having a free arm having a front side and a back side, comprising, means for holding a work to be embroidered and for moving said work, means for detecting a contact or access between said work and said free arm provided on said free arm at said front side and said back side thereof.

2. The embroidery stitching device as defined in claim 1, further comprising means which is responsive to a detecting signal from said detecting means to detect an area where said work is to be moved.

3. The embroidery stitching device as defined in claim 2, further comprising means for indicating said area where said work is to be moved.

4. The embroidery stitching device as defined in claim 2, further comprising means for giving information regarding a pattern to be embroidered to said work and means responsive to said information from said information giving means and said area detected by said detecting means to discriminate if said pattern may be embroidered or not.

5. The embroidery stitching device as defined in claim 4, further comprising means for designating a position where said pattern is embroidered.

6. The embroidery stitching device as defined in claim 4, further comprising means for designating a position where said pattern is embroidered, said position designating means being operated to change an embroidering position in case said discriminating means discriminates said pattern to be not embroidered.

7. The embroidery stitching device as defined in claim 4, further comprising means for designating a size of a pattern to be embroidered.

8. The embroidery stitching device as defined in claim 4, further comprising means for designating a size of a pattern to be embroidered and means for changing the designated size of the pattern in case the size of the patern designated by said designating means is discriminated by said discriminating means to be something to be improper for embroidering.

9. An embroidery stitching sewing machine having a free arm having a front side and a back side, comprising, means for holding a work to be embroidered and for moving said work, means for detecting a contact or access between said work and said free arm provided on said free arm at said front side and said back side thereof.

10. The embroidery stitching sewing machine as defined in claim 9, further comprising means which is responsive to a detecting signal from said detecting means to detect an area where said work is to be moved.

11. The embroidery stitching sewing machine defined in claim 10, further comprising means for indicating said area where said work is to be moved.

12. The embroidery stitching sewing machine as defined in claim 10, further comprising means for giving information regarding a pattern to be embroidered to said work and means responsive to said information from said information giving means and said detected area detected by said detecting means to discriminate if said pattern may be embroidered or not.

13. The embroidery stitching sewing machine as defined in claim 12, further comprising means for designating a position where said pattern is embroidered.

14. The embroidery stitching sewing machine as defined in claim 12, further comprising means for designating a position where said pattern is embroidered, said position designating means being operated to change an embroidering position in case said discriminating means discriminates said pattern to be not embroidered.

15. The embroidery stitching sewing machine as defined in claim 12, further comprising means for designating a size of a pattern to be embroidered.

16. The embroidery stitching sewing machine as defined in claim 12, further comprising means for designating a size of a pattern to be embroidered and means for changing the designated size of the pattern in case the size of the patern designated by the designating means is discriminated by said discriminating means to be something to be improper for embroidering.

* * * * *